US010661335B2

(12) United States Patent
Lee et al.

(10) Patent No.: US 10,661,335 B2
(45) Date of Patent: May 26, 2020

(54) LOCALIZED TORSIONAL SEVERE PLASTIC DEFORMATION METHOD FOR CONICAL TUBE METALS

(71) Applicant: AGENCY FOR DEFENSE DEVELOPMENT, Daejeon (KR)

(72) Inventors: Seong Lee, Daejeon (KR); Seong-Ho Yang, Daejeon (KR); Lee-Ju Park, Daejeon (KR); Hak-Jun Kim, Daejeon (KR); Hyoung-Seop Kim, Pohang-si (KR); See-Am Lee, Cheonan-si (KR); Ho-Yong Um, Incheon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 476 days.

(21) Appl. No.: 15/610,764

(22) Filed: Jun. 1, 2017

(65) Prior Publication Data

US 2018/0056378 A1 Mar. 1, 2018

(30) Foreign Application Priority Data

Aug. 23, 2016 (KR) ..... 10-2016-0107176

(51) Int. Cl.
*B21D 22/16* (2006.01)
*B22D 13/02* (2006.01)
(Continued)

(52) U.S. Cl.
CPC ..... *B22D 13/02* (2013.01); *B21D 22/02* (2013.01); *B21D 31/00* (2013.01); *B21D 51/10* (2013.01);
(Continued)

(58) Field of Classification Search
CPC ..... B21C 23/001; B21C 23/08; B21C 37/18; B21D 22/14; B21D 22/16; B21D 22/18;
(Continued)

(56) References Cited

U.S. PATENT DOCUMENTS 3,470,720 A * 10/1969 Campbell ..... B21D 51/08 72/69
4,982,589 A * 1/1991 Nomura ..... B21J 9/025 72/406
(Continued)

FOREIGN PATENT DOCUMENTS

KR 10-2013-0068827 A 6/2013
KR 101323168 11/2013

OTHER PUBLICATIONS

Dong Jun Lee, "Analyses of Plastic Deformation Behavior during High-Pressure Torsion Process by Finite Element Method and Experiments", Department of Materials Science and Engineering Pohang University of Science and Technology, Dec. 21, 2011, Pohang, Korea.

*Primary Examiner* — Edward T Tolan
(74) *Attorney, Agent, or Firm* — LRK Patent Law Firm

(57) ABSTRACT

In a localized torsional severe plastic deformation method for conical tube metal, a desired region of a conical tube metal can be subjected to severe plastic deformation using molds in which roughness is formed at predetermined regions. The method includes roughening a predetermined region of each of the molds; sticking the conical tube metal only to the roughened regions of the molds; moving the lower mold toward the upper mold to apply a load to the conical tube metal; and rotating the molds to apply severe plastic deformation to the conical tube metal only at the regions stuck to the roughened regions of the molds.

6 Claims, 6 Drawing Sheets

(51) Int. Cl.

| | |
|---|---|
| ***B21D 51/10*** | (2006.01) |
| ***B21D 22/02*** | (2006.01) |
| ***B21D 31/00*** | (2006.01) |
| ***B22F 3/00*** | (2006.01) |
| ***B22F 5/00*** | (2006.01) |
| ***B22F 5/10*** | (2006.01) |
| *E21B 43/12* | (2006.01) |
| *E21B 43/26* | (2006.01) |

(52) U.S. Cl.
CPC ..... *B22F 3/00* (2013.01); *B22F 5/007* (2013.01); *B22F 5/106* (2013.01); *E21B 43/126* (2013.01); *E21B 43/26* (2013.01)

(58) Field of Classification Search
CPC ..... B21D 22/185; B21D 51/10; B21D 31/00; B22D 13/02
See application file for complete search history.

(56) References Cited

U.S. PATENT DOCUMENTS

| | | | | |
|---|---|---|---|---|
| 7,096,705 | B2 * | 8/2006 | Segal | B21C 23/001 72/253.1 |
| 9,447,487 | B2 * | 9/2016 | Kim | C21D 9/0068 |
| 2007/0039369 | A1 * | 2/2007 | Iwanaga | B21C 1/24 72/255 |

* cited by examiner

LOCALIZED TORSIONAL SEVERE PLASTIC DEFORMATION METHOD FOR CONICAL TUBE METALS

CROSS REFERENCE TO RELATED APPLICATION(S)

This application claims the benefit of Korean Patent Application No. 10-2016-0107176, filed Aug. 23, 2016, which is hereby incorporated by reference in its entirety into this application.

BACKGROUND OF THE INVENTION

1. Technical Field

The present disclosure relates to a localized torsional severe plastic deformation method for conical tube metal. More particularly, the present disclosure relates to a localized torsional severe plastic deformation method for conical tube metal in which a desired region of a conical tube metal can be subjected to severe plastic deformation using molds in which roughness is formed at predetermined regions.

2. Description of Related Art

Generally, severe plastic deformation is a technique in which major plastic deformation is applied to a metal material to make grains of the material ultrafine.

When a metal material is subjected to shear deformation, its crystal grains are stretched in the deformation direction to form sub-grains having small angular boundaries. Under this condition, the sub-grains become independent with the increase of the crystal grain boundary angle therebetween, so that the grains become increasingly fine.

Various studies into the grain refinement of metal materials are ongoing throughout the world because the formation of ultrafine crystal grains brings about a considerable improvement in mechanical properties such as strength, hardness, wear resistance, superplasticity, etc.

Severe plastic deformation methods developed to date include equal channel angular pressing, high-pressure torsion, accumulative roll bonding, and the like.

Among these, high-pressure torsion is a technique in which a shear strain is applied to a material under a high hydrostatic pressure while torsion is created in the material by rotation. However, this technique is problematic in that because the rotational strain increases in proportion to the distance from the rotational axis, non-uniform strain is distributed across the material from the center to the edges in the radial direction.

Thus, the metal material exhibits great variation in mechanical properties and local microstructures and is brittle in particular regions, so that a piece of material having a large surface area is difficult to process with the conventional high-pressure torsion.

RELATED ART DOCUMENT

Patent Document

Korean Patent No. 10-1323168

SUMMARY OF THE INVENTION

Accordingly, the present invention has been made keeping in mind the above problems occurring in the related art, and an object of the present disclosure is to provide a localized torsional severe plastic deformation method in which molds having roughness at predetermined regions are used to locally subject a conical tube metal to severe plastic deformation.

Another object of the present disclosure is to provide a localized torsional severe plastic deformation method for conical tube metal, using a plurality of molds that are roughened at different regions and are capable of local deformation, whereby uniform strain and mechanical properties can be provided across the conical tube metal by setting different numbers of rotations for each of the multiple molds.

In order to accomplish the above object, the present invention provides a localized torsional severe plastic deformation method for a conical tube metal, using a lower mold and an upper mold fit respectively to internal and external contours of the conical tube metal, the method comprising:

roughening a predetermined region of each of the molds;

sticking the conical tube metal only to the roughened regions of the molds;

moving the lower mold toward the upper mold to apply a load to the conical tube metal; and rotating the molds to apply severe plastic deformation to the conical tube metal only at the regions stuck to the roughened regions of the molds.

In one embodiment, multiple copies of either or both of the upper mold and the lower mold are used to subject the conical tube metal to severe plastic deformation, the copies being roughened at respectively different regions and rotated by respectively different numbers of turns.

In another embodiment, a number of the rotations of the multiple molds that are roughened at respectively different regions is controlled to cause uniform deformation across the conical tube metal.

In another embodiment, the multiple molds that are roughened at respectively different regions are either the upper mold or the lower mold.

In another embodiment, wherein the upper mold is entirely roughened and the lower mold is roughened in a predetermined region.

In another embodiment, the lower mold is entirely roughened and the upper mold is roughened in a predetermined region.

In another embodiment, both the upper mold and the lower mold are roughened in respective predetermined regions.

In another embodiment, the upper mold and the lower mold are rotated independently or simultaneously.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
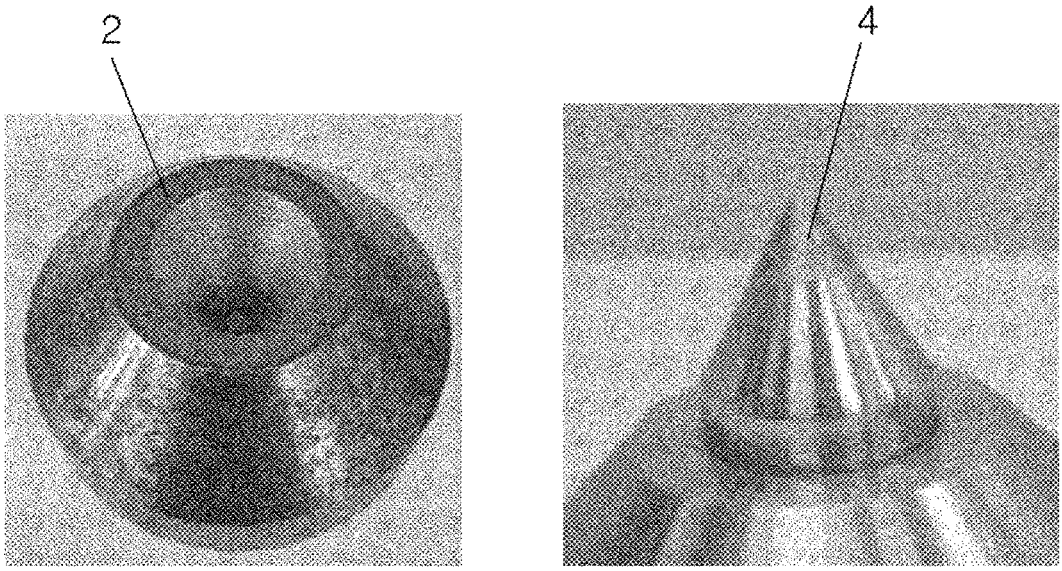
FIG. 1 shows an upper mold and a lower mold in accordance with an embodiment of the present disclosure.

The present invention will be described in detail below with reference to the accompanying drawings. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc. of components in the drawings may be exaggerated to make the description clearer.

Below, a detailed description will be given of particular embodiments of the present disclosure in conjunction with the accompanying drawings.

According to some embodiments, the present disclosure provides a localized torsional severe plastic deformation method in which molds having roughness in predetermined regions are used to locally subject a conical tube metal to severe plastic deformation.

Figure 2:
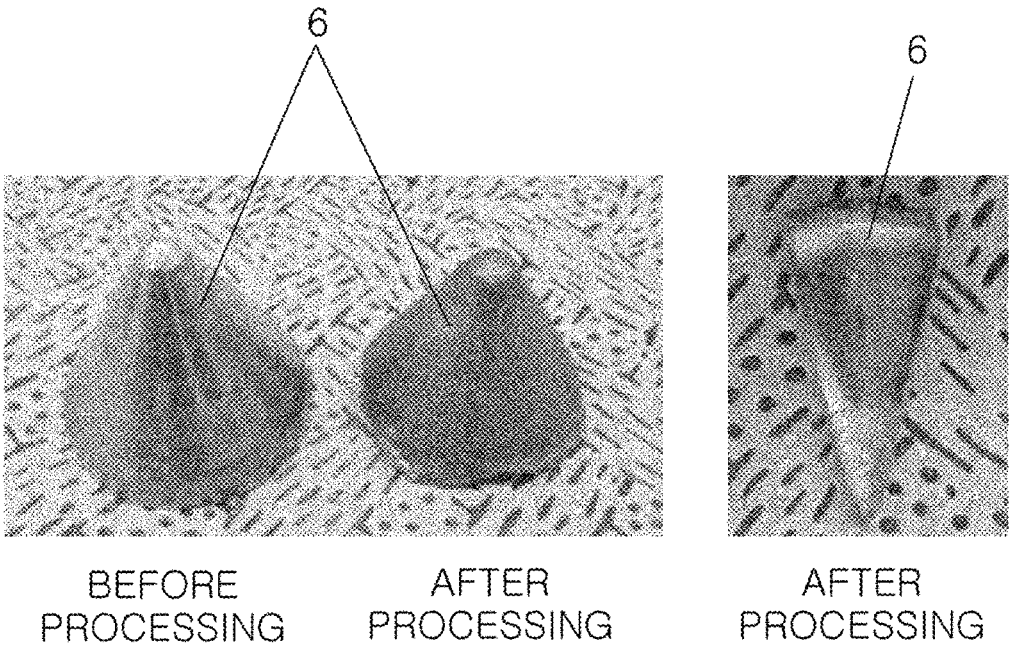
FIG. 2 shows a conical tube metal before and after being processed with the molds of FIG. 1.
Figure 3:
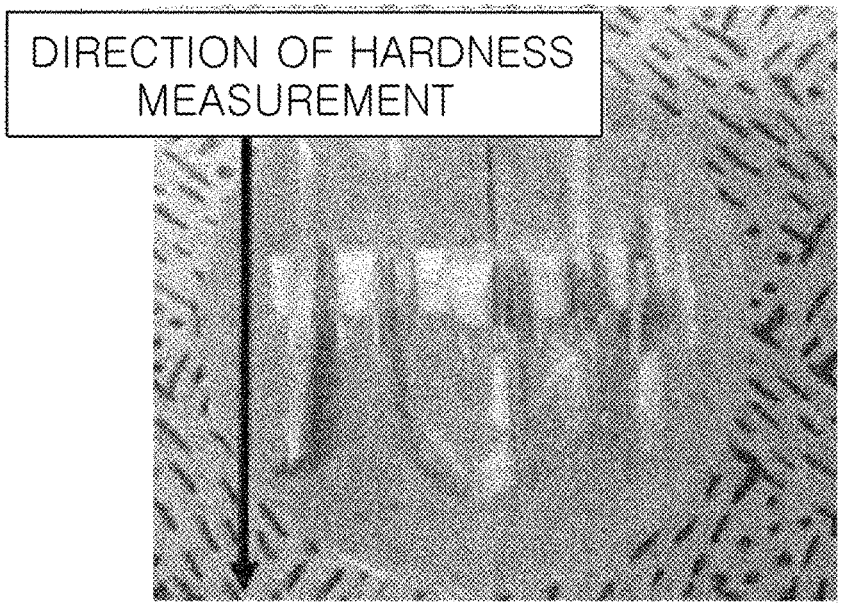
FIG. 3 is a photographic image of an array of pieces longitudinally cut from the conical metal tube that has been processed as shown in FIG. 2.
Figure 4:
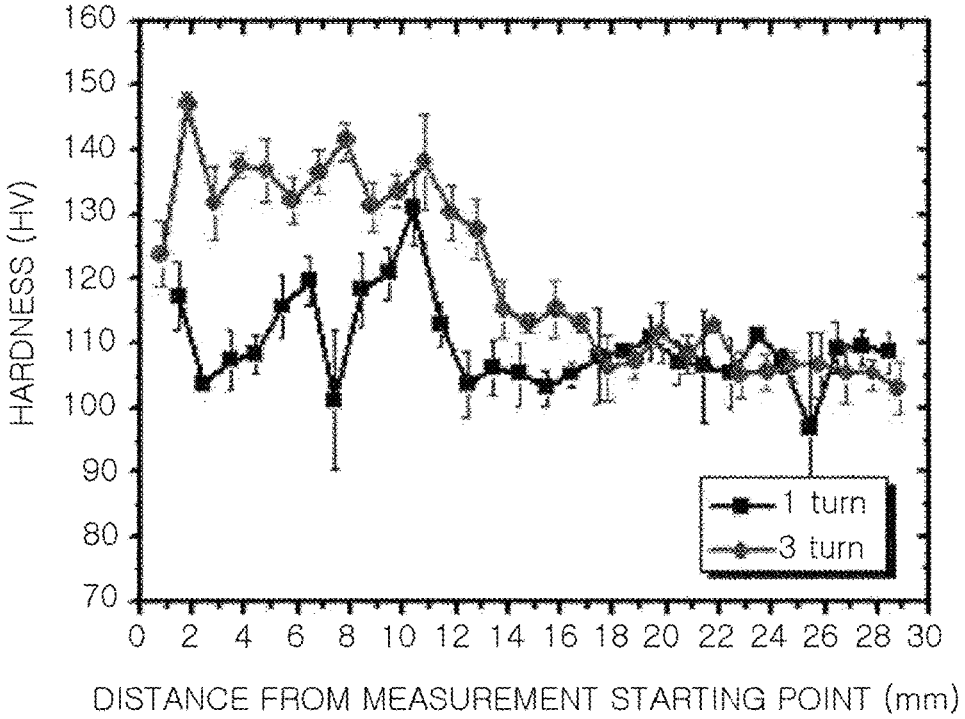
FIG. 4 is a graph of hardness measurements of conical tube metals depending on the number of rotations.
Figure 5:
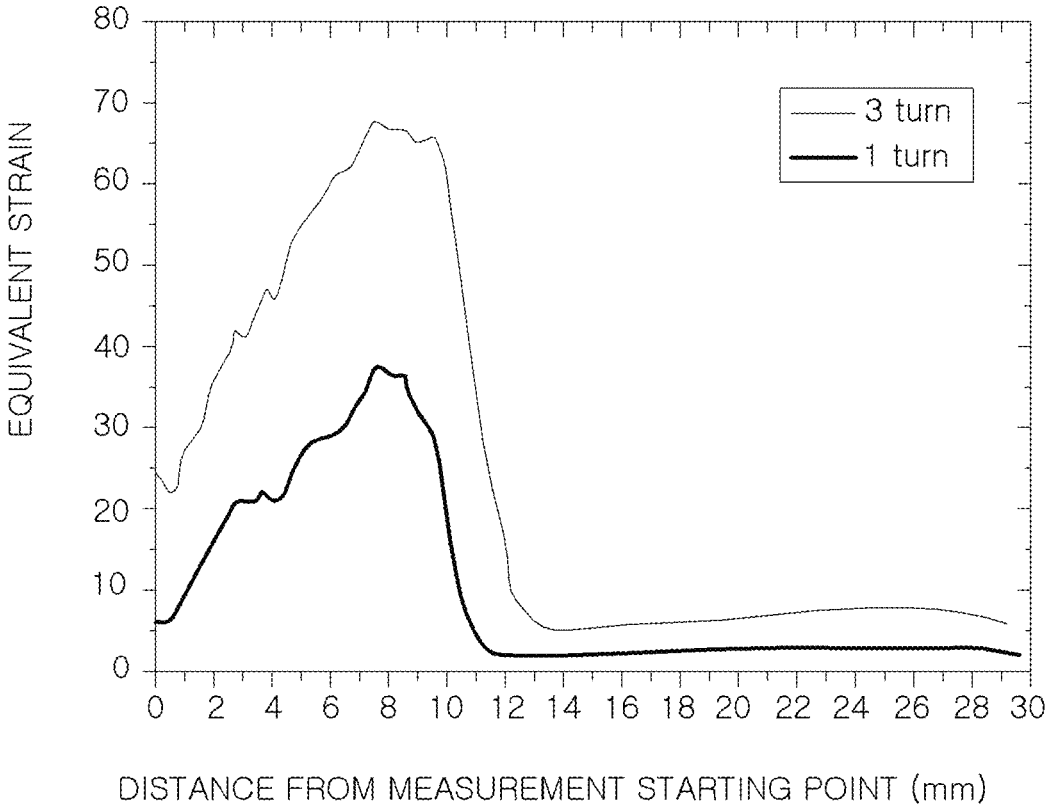
FIG. 5 is a graph of equivalent strain of conical tube metals depending on the number of rotations as predicted by finite element analysis.
Figure 6:
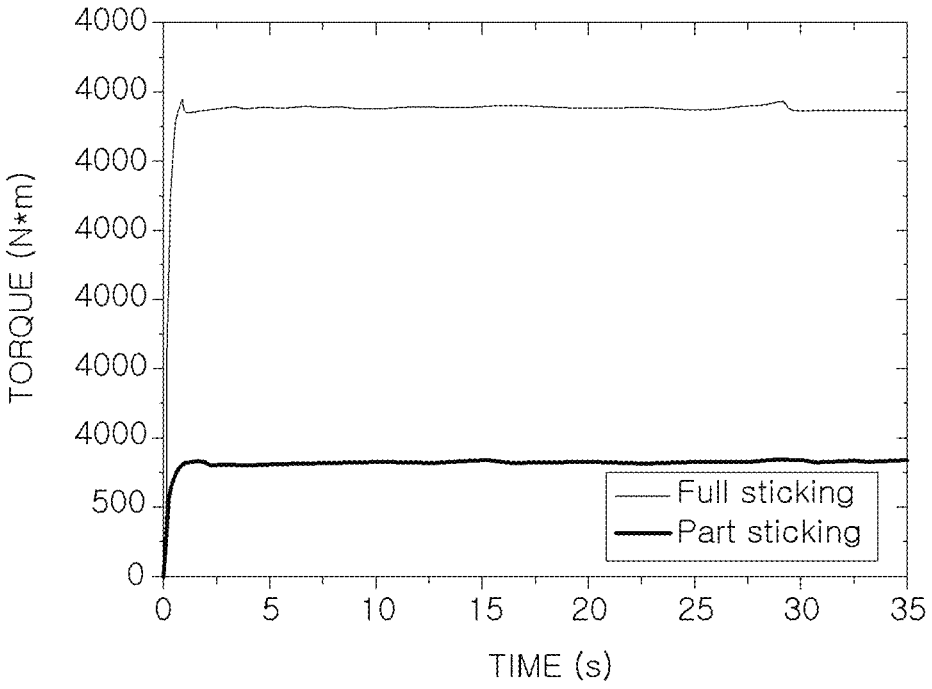
FIG. 6 is a graph of torques of conical tube metals depending on the degree of sticking.

FIG. 1 shows an upper mold and a lower mold in accordance with an embodiment of the present disclosure. FIG. 2 shows a conical tube metal before and after being processed with the molds of FIG. 1. FIG. 3 is a photographic image of an array of pieces longitudinally cut from the conical metal tube that has been processed as shown in FIG. 2. FIG. 4 is a graph of hardness measurements of conical tube metals depending on the number of rotations. FIG. 5 is a graph of equivalent strains of conical tube metals depending on the number of rotations as predicted by finite element analysis. FIG. 6 is a graph of torques of conical tube metals depending on the degree of sticking.

The localized torsional severe plastic deformation method in accordance with the present disclosure uses a lower mold 4 and an upper mold 2, fit respectively to internal and external contours of a conical tube metal 6, and comprises:

roughening a predetermined region of each of the molds;

sticking the conical tube metal only to the roughened regions of the molds;

moving the lower mold toward the upper mold to apply a load to the conical tube metal; and rotating the molds to apply severe plastic deformation to the conical tube metal only at the regions stuck to the roughened regions of the molds.

First, the predetermined region of each of the molds 2 and 4 is a site to which a target region of the conical tube metal 6 to be deformed will be stuck.

For example, as shown in FIG. 1, the upper mold 2, which is to be mounted on the outside of the conical tube metal 6, is provided with roughness on the entire inner surface thereof in order to stick the entire outside of the conical tube metal 6 while roughness is formed only on the upper end area of the lower mold 4, which is to be mounted on the inside of the conical tube metal 6, in order to locally stick only the upper end area of the inside of the conical tube metal 6.

The upper mold 2 and the lower mold 4, which are both provided with roughness as described above, are installed in a high-pressure torsion machine.

The conical tube metal 6 is mounted on the lower mold 4 so that the inside of the conical tube metal 6 is stuck only to the roughened upper end area of the lower mold 4. Then, the lower mold 4 is moved toward the upper mold so that the outside of the conical tube metal 6 is completely stuck to the entirely roughened upper mold 2.

In this regard, the compressive force based on the movement of the lower mold 4 toward the upper mold 2 exerts a load on the conical tube metal 6.

After a desired constant load is applied to the conical tube metal 6 for a predetermined period of time, either the lower mold 4 or the upper mold 2 is rotated to subject the conical tube metal 6 to localized torsional severe plastic deformation only at the regions that stick to the upper mold 2 and the lower mold 4.

In FIG. 2, a conical tube metal 6 before processing is compared with one that has been processed with a combination of the upper mold 2 and the lower mold 4 of FIG. 1.

With reference to FIG. 2, because the conical tube metal 6 is stuck only to the roughened regions of the upper mold 2 and the lower mold 4 and then processed, the roughness of the molds 2 and 4 is imprinted in the conical tube metal 6 only at the regions stuck to the molds 2 and 4.

As described above, the application of torsion to the conical tube metal 6 may be achieved by rotating either the upper mold 2 or the lower mold 4. Alternatively, both the upper mold 2 and the lower mold 4 may be rotated simultaneously simultaneously with different angular velocities to apply torsion to the conical tube metal 6.

The severe plastic deformation method described above makes it possible to subject the conical tube metal 6 to torsion under the condition that there is major local friction between the conical tube metal 6 and the upper mold 2 and between the conical tube metal 6 and the lower mold 4 while the material is under a very large hydrostatic pressure as it is compressed between the upper mold 2 and the lower mold 4, whereby the conical tube metal 6 stuck to the upper mold 2 and the lower mold 4 can be locally shear-strained without slipping.

In addition, the hydrostatic pressure and shear strain allows the microstructure of the conical tube metal 6 to have ultrafine grains or nanocrystalline grains.

The conical tube metal 6 to which local torsion is applied, as stated above, by the upper mold 2 and the lower mold 4, both of which are partly roughened, can be imparted with a desired amount of strain by controlling the number of rotations upon severe plastic deformation.

According to some embodiments of the present disclosure, the upper mold 2 and the lower mold 4, which are both roughened as shown in FIG. 1, are employed while the conical tube metal 6 is made of copper.

A load of 80 tons (about 800 MPa) was applied to each of two conical pieces of tube metal 6, and after the application of the load, the compressive force was maintained for 10 sec without rotation.

Subsequently, severe plastic deformation was performed by rotating the lower mold 4 at 1 rpm by one turn for one conical piece of tube metal 6 and by three turns for the other.

In conjunction with this experiment, finite element analysis was performed using the commercially available software DEFORM 3D Ver 6.1 in order to predict the strain of the conical tube metal 6 and to calculate the torque necessary for processing.

Under the same conditions as the experiment, the finite element analysis was performed on the following assumptions: the conical tube metal 6 is stuck to the molds 2 and 4 at the roughened regions while a friction coefficient of 0.1, which is evident when cold working with a typical steel mold, is assumed for the other regions; and the physical properties of copper, calculated on the basis of dislocation density, were employed.

FIGS. 4 and 5 respectively show Vickers hardness measurements and finite element analysis-predicted equivalent strains of conical tube metals depending on the number of rotations. The hardness was measured in the direction depicted in FIG. 3.

In the experiment, hardness measurements and strain values respectively detected in a part corresponding to the roughened region of the lower mold 4 and a part that was set to be stuck in the finite element analysis were much higher than those detected in the other parts. The conical tube metal 6 rotated by three turns exhibited higher hardness and strain than that rotated by one turn.

For the torque necessary for the deformation process, as shown in FIG. 6, comparisons were conducted between the conical tube metals 6 that were partly and fully stuck. Greatly reduced torques were observed in the case of partial sticking because the area to be processes was reduced. Hence, when a high-pressure torsion machine of the same performance is employed, the localized torsional method of the present disclosure allows for processing a larger area of the conical tube metal 6 than a conventional method, in which strain is entirely applied, because the amount of torque necessary for torsion can be reduced.

A conical tube metal is entirely processed when the high-pressure torsion process described in Korean Patent No. 10-1323168 is used. In contrast, when the conical tube metal 6 is torsionally processed using the upper mold 2 and the lower mold 4 depicted in FIG. 1 according to the method of the present disclosure, deformation was found to be concentrated on the upper end region of the conical tube metal 6.

A combination of the upper mold 2 and the lower mold 4, depicted in FIG. 1, is only an embodiment of the present disclosure. Various other modifications fall within the scope of the present disclosure. For use in processing the conical tube material 6, for example, the lower mold 4 may be entirely roughened while a predetermined region of the upper mold 2 may be provided with roughness. In an alternative embodiment, both the upper mold 2 and the lower mold 4 may be locally roughened.

Either of the upper mold 2 or the lower mold 4 may be present in multiple numbers.

For example, there may be multiple lower molds 2 that are roughened at respectively different regions. When each of them is applied to one conical piece of tube metal 6, it may be rotated by a different number of turns. Thus, uniform strains are applied to respective portions of the conical piece of tube metal 6, so that the mechanical properties of the conical tube metal 6, such as microstructures, can be uniformly altered.

The conical tube metal 6 varies in material and size depending on the purpose thereof. The molds 2 and 4 are fabricated according to the contour of the conical tube metal 6.

According to the method of the present disclosure, as described hitherto, a conical tube metal can be locally subjected to severe plastic deformation using molds in which roughness is formed at predetermined regions.

Employing a plurality of molds that are roughened at different regions in addition to being capable of local deformation, the method of the present disclosure can provide uniform strain and mechanical properties across the conical tube metal by setting different numbers of rotations for each of the multiple molds.

When a high-pressure torsion machine having the same performance is employed, the localized torsional method of the present disclosure allows for processing of a larger area of the conical tube metal than the conventional method, in which strain is entirely applied, because the requirement for torque for torsion can be reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, optimal embodiments of the present invention have been disclosed in the drawings and the specification. Although specific terms have been used in the present specification, these are merely intended to describe the present invention and are not intended to limit the meanings thereof or the scope of the present invention described in the accompanying claims. Therefore, those skilled in the art will appreciate that various modifications and other equivalent embodiments are possible from the embodiments. Therefore, the technical scope of the present invention should be defined by the technical spirit of the claims.

What is claimed is:

1. A localized torsional severe plastic deformation method for a conical tube metal, using lower and upper molds fit respectively to internal and external contours of the conical tube metal, the method comprising:

roughening predetermined regions of each of the lower and upper molds;

sticking the conical tube metal to only the roughened regions of the lower and upper molds;

moving the lower mold toward the upper mold to apply a load to the conical tube metal; and rotating the lower and upper molds to apply severe plastic deformation to the conical tube metal at only the regions stuck to the roughened regions of the lower and upper molds, wherein one or both of the upper mold and the lower mold are used to subject the conical tube metal to severe plastic deformation, the upper mold and the lower mold being roughened at respectively different regions.

2. The localized torsional severe plastic deformation method of claim 1, wherein the upper mold and the lower mold are rotated by respectively different numbers of turns.

3. The localized torsional severe plastic deformation method of claim 2, wherein the upper mold is entirely roughened and the lower mold is roughened in a predetermined region.

4. The localized torsional severe plastic deformation method of claim 2, wherein the lower mold is entirely roughened and the upper mold is roughened in a predetermined region.

5. The localized torsional severe plastic deformation method of claim 2, wherein both the upper mold and the lower mold are roughened in respective predetermined regions.

6. The localized torsional severe plastic deformation method of claim 2, wherein the upper mold and the lower mold are rotated independently or simultaneously.

* * * * *